US005951367A

United States Patent [19]

Hsu

[11] Patent Number: 5,951,367

[45] Date of Patent: Sep. 14, 1999

[54] CUP PADDING FOR SUPPORTING THE BREAST

[76] Inventor: Yu-Tu Hsu, 245, Guang Ming Road, Dah Jea Cheng, Taichung Hsien, Taiwan

[21] Appl. No.: 09/018,573

[22] Filed: Feb. 4, 1998

[51] Int. Cl.[6] ..... A41C 3/00

[52] U.S. Cl. ..... 450/57; 2/267; 2/455

[58] Field of Search ..... 2/455, 456, 459, 2/460, 461, 462, 463, 464, 465, 466, 467, 2.5, 16, 24, 267, 268; 450/30, 31, 32, 53, 54, 55, 56, 57

[56] References Cited

U.S. PATENT DOCUMENTS 2,851,692 9/1958 Livingston et al. ..... 2/267

5,480,429 1/1996 Weber-Unger ..... 2/267

5,522,892 6/1996 Lin ..... 450/39

*Primary Examiner*—Gloria Hale

*Attorney, Agent, or Firm*—Birch, Stewart Kolasch & Birch, LLP

[57] ABSTRACT

A cup padding for supporting the breast, having a cup-like base made from rubber, the cup-like base having a convex front side wall and a concave rear side wall fitting the breast, the rear side wall having a plurality of cells, and a plurality of air vents respectively extended from the cells to the front side wall for ventilation, the depths of the cells closer to the border area of the rear side wall being relatively smaller than the depths of the cells closer to the center area.

13 Claims, 4 Drawing Sheets

CUP PADDING FOR SUPPORTING THE BREAST

BACKGROUND OF THE INVENTION

The present invention relates to a cup padding for putting inside a brassiere to support the breast.

In order to have the breasts full and voluptuous, a woman may try every possible medical measure, including surgical operation. However, taking a surgical operation in order to make the breasts look good tends to induce side effects. The most simple way to make the breasts look good is to put a cup padding 3 in the brassiere 2 on each breast 1 (see FIG. 4). The cup padding 3, as shown in FIG. 4, is directly molded from silicon rubber, having a convex front side and a concave rear side fitting the breast. The thickness of the cup padding gradually reduces from the center area toward the border area. Because the cup padding is a solid silicon rubber cup, it has a certain weight. If the cup padding is mad thicker, its weight is relatively increased, further its flexibility is relatively reduced. Because the breast bears the pressure of the cup padding, the user feels uncomfortable when bearing a thick cup padding.

SUMMARY OF THE INVENTION

The present invention has been accomplished to provide a cup padding which eliminates the aforesaid drawbacks. According to one aspect of the present invention, the cup padding comprises a the cup-like silicon rubber base having a convex front side wall and a concave rear side wall fitting the breast, the rear side wall having a plurality of cells, which diminishes the weight and material of the cup-like silicon rubber base, the depths of the cells closer to the border area of the rear side wall being relatively smaller than the depths of the cells closer to the center area. According to another aspect of the present invention, the cells are arranged in the form of a beehive. According to still another aspect of the present invention, the rear side wall has a plurality of air vents respectively extended from the cells to the front side wall of the silicon rubber base for ventilation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Figure 1:
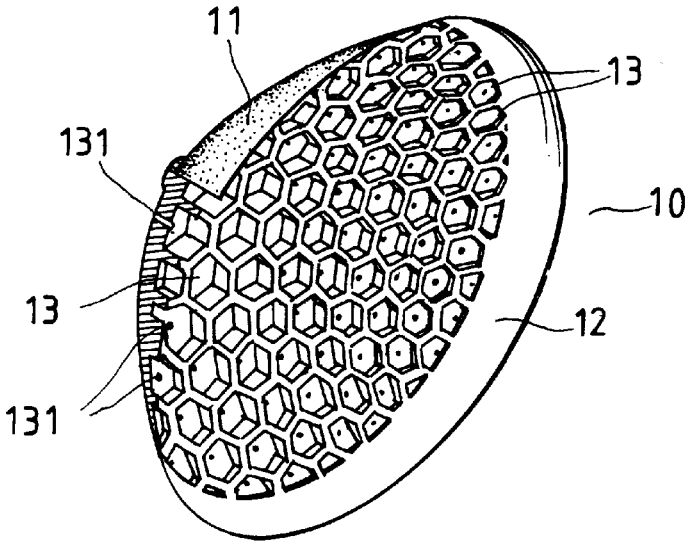
FIG. 1 is a cutaway view of a cup padding according to the present invention.
Figure 2:
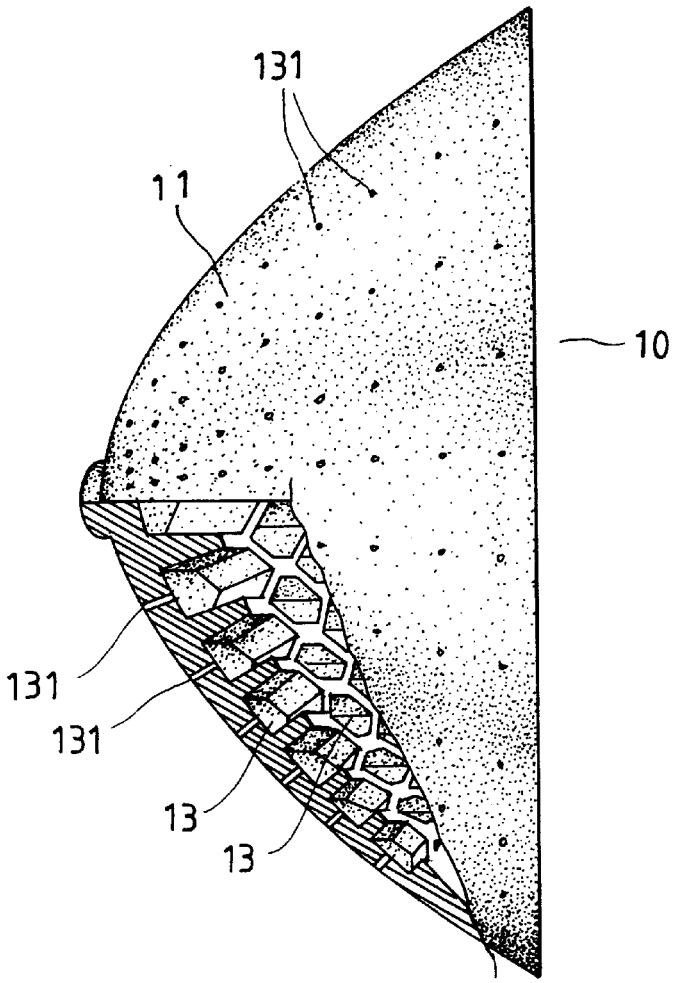
FIG. 2 is a plain view partially in section of the cup padding shown in FIG. 1.

Referring to FIGS. 1 and 2, a cup padding in accordance with the present invention is made from soft and elastic silicon rubber, rubber, or the like, comprising a cup-like base 10. The cup-like base 10 has a convex front side wall 11, and a concave rear side wall 12 fitting the breast. Beehive-like cells 13 are provided at the rear side wall 12. The depths of the cells 13 closer to the border area of the rear side wall 12 are relatively smaller than the depths of the cells 13 closer to the center area. The cells 13 diminish the weight and material of the cup padding, and improve its flexibility. A plurality of air vents 131 are provided at the front side wall 11, and respectively extended to the center of the cells 13 for ventilation. The cells 13 can have any of a variety of shapes. For example, the cells 13 can be rounded blind holes, square blind holes, etc.

Figure 3:
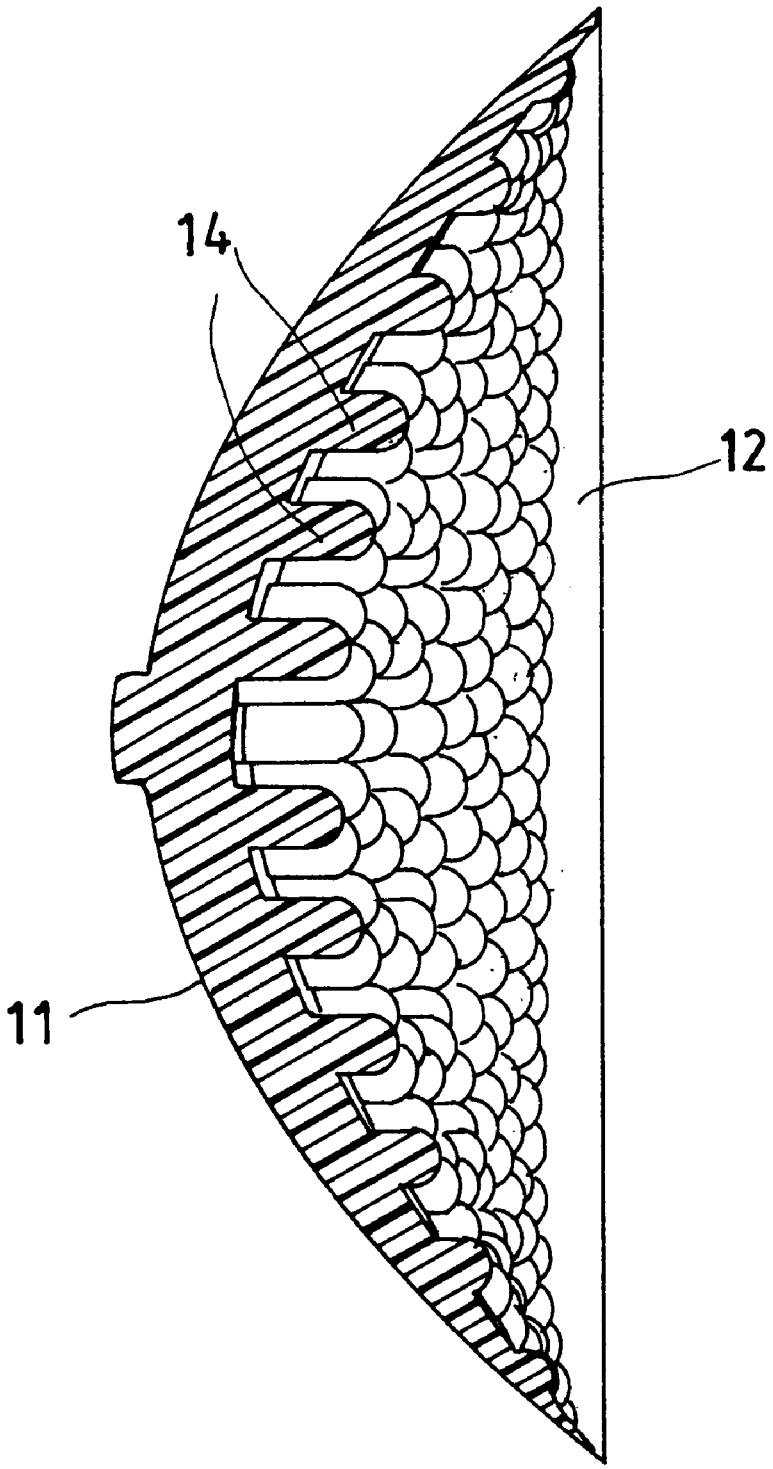
FIG. 3 is a plain view in section of an alternate form of the present invention.
Figure 4:
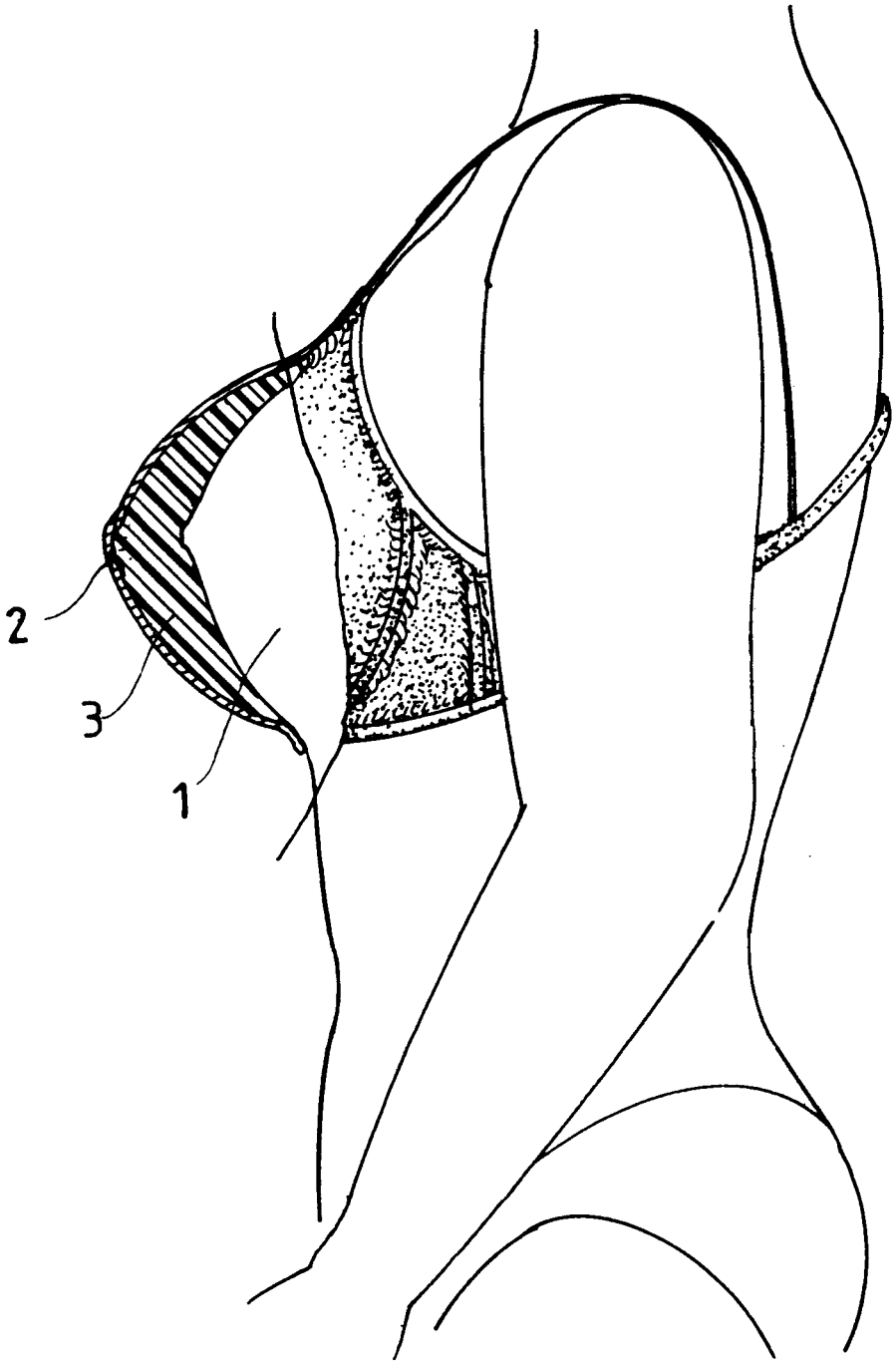
FIG. 4 shows a cup padding put inside a brassiere on the breast according to the prior art.
Figure 5:
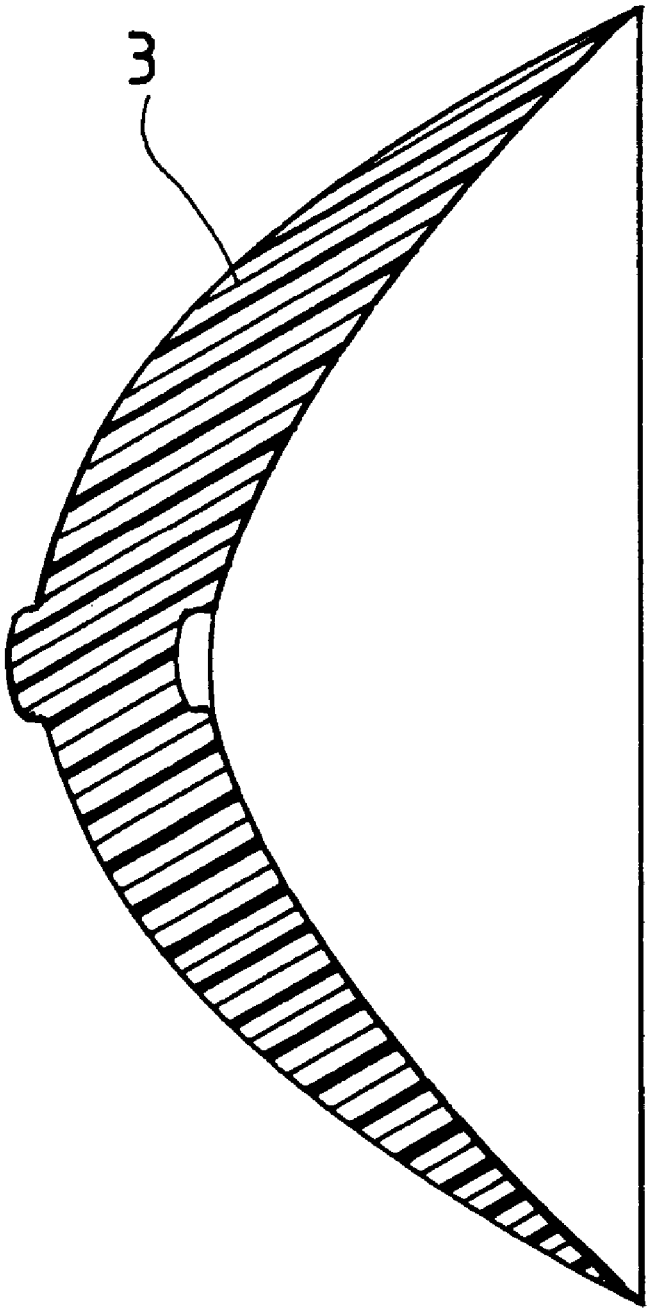
FIG. 5 is a sectional view of the prior art cup padding shown in FIG. 4.

FIG. 3 shows an alternate form of the present invention, in which a plurality of studs 14 are raised from the rear side wall 12. The heights of the studs 14 closer to the border area of the rear side wall 12 are relatively smaller than the heights of the studs 14 closer to the center area. The design of the studs 14 also diminishes the weight and material of the cup padding. Further, this designs provides a massaging effect to the breast.

It is to be understood that the drawings are designed for purposes of illustration only, and are not intended as a definition of the limits and scope of the invention disclosed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What the invention claimed is:

1. A cup padding for supporting a breast comprising a flexible cup-shaped base, said cup-shaped base having a convex front side wall and a concave rear side wall fitting a breast, wherein said rear side wall includes means for reducing weight of the cup-shaped base, the means for reducing weight including a plurality of cells, depths of the cells closer to a border area of said rear side wall being relatively smaller than depths of the cells closer to a center area of the cup-shaped base, walls of the cells being engaged with adjacent cells such that a closely packed cell arrangement is provided.

2. The cup padding of claim 1, wherein said cells are arranged in a form of a beehive.

3. The cup padding of claim 1, wherein a plurality of air vents are at the front side wall, and respectively extended from said cells to said front side wall for ventilation.

4. The cup padding of claim 1, wherein a plurality of studs are raised from said rear side wall, the heights of the studs closer to the border area of said rear side wall are relatively smaller than the heights of the studs closer to the center area.

5. The cup padding of claim 1, wherein the cup-shaped based is made from at least one of rubber and silicon rubber.

6. The cup padding of claim 1, wherein a majority of the cells are empty when the cup padding is worn by a user.

7. The cup padding of claim 1, wherein all of the cells are empty when the cup padding is worn by a user.

8. The cup padding of claim 6, wherein the cells are arranged in a form of a beehive with the cells having a hexagonal shape.

9. The cup padding of claim 8, further comprising a plurality of air vents in the front side wall, the air vents extend from the cells to the front side wall for ventilation, the air vents and cells forming an unobstructed passageway.

10. The cup padding of claim 9, wherein the cells have a uniform diameter along their length.

11. The cup padding of claim 1, wherein the cells are arranged in a form of a beehive with the cells having a hexagonal shape.

12. The cup padding of claim 11, further comprising a plurality of air vents in the front side wall, the air vents extend from the cells to the front side wall for ventilation, the air vents and cells forming an unobstructed passageway.

13. The cup padding of claim 1, wherein the cells have a uniform diameter along their length.

* * * * *